US005982268A

United States Patent [19]

Kawanishi

[11] Patent Number: 5,982,268

[45] Date of Patent: Nov. 9, 1999

[54] THIN TYPE FUSES

[75] Inventor: Toshiro Kawanishi, Osaka, Japan

[73] Assignee: Uchihashi Estec Co., Ltd, Osaka, Japan

[21] Appl. No.: 09/052,018

[22] Filed: Mar. 31, 1998

[51] Int. Cl.[6] ..... H01H 85/046; H01H 85/044; H01H 69/02

[52] U.S. Cl. ..... 337/297; 337/231; 29/623

[58] Field of Search ..... 337/160, 152, 337/227, 297, 296, 231; 29/623

[56] References Cited

U.S. PATENT DOCUMENTS

| | | | |
|---|---|---|---|
| 4,000,054 | 12/1976 | Marcantonio | 204/192 |
| 4,503,315 | 3/1985 | Kamioka et al. | 219/121 LE |
| 4,626,818 | 12/1986 | Hilgers | 337/166 |
| 5,469,981 | 11/1995 | Srikrishnan et al. | 216/13 |
| 5,552,757 | 9/1996 | Blecha et al. | 337/297 |
| 5,585,662 | 12/1996 | Ogawa | 257/529 |

FOREIGN PATENT DOCUMENTS

| | | | |
|---|---|---|---|
| 407006677 | 1/1995 | Japan | H01H 37/36 |
| 407201263 | 8/1995 | Japan | H01H 37/76 |
| 407201264 | 8/1995 | Japan | H01H 37/76 |
| 407201265 | 8/1995 | Japan | H01H 37/36 |
| 8-77899 | 3/1996 | Japan . | |
| 410106425 | 4/1998 | Japan | H01H 85/00 |

*Primary Examiner*—Leo P. Picard
*Assistant Examiner*—Anatoly Vortman
*Attorney, Agent, or Firm*—Sughrue, Mion, Zinn, Macpeak & Seas, PLLC

[57] ABSTRACT

A thin type fuse of the present invention has a structure in which each tip portion of a pair of lead conductors is put out from one side of an insulating substrate film on to the other side thereof so as to keep watertightness, the tip portions of the lead conductors on the other side of the insulating substrate film are connected by a fuse element, and the other side of the insulating substrate film is covered with an insulating covering film which is in contact with the fuse element. The contact of the fuse element with the insulating covering film is surface contact and a flux is filled around said contact surface.

8 Claims, 3 Drawing Sheets

THIN TYPE FUSES

BACKGROUND OF THE INVENTION

1. Field of the Invention

The present invention relates to a thin type fuse.

2. Description of the Related Art

Although current fuses and thermal fuses are widely used as members to protect electrical devices, thinning of these fuses is required for mounting space savings.

Therefore, a thin type fuse has been proposed in Examined Japanese Patent Publication No. Hei. 7-95419. As shown in FIG. 4A, FIG. 4B (a diagram of B—B cross section specified in FIG. 4A), and FIG. 4C (an underside view), swollen portions 21' and 21' are formed in the tip portions of a pair of band-like lead conductors 2' and 2' and put out from one side of plastic insulating substrate film 1' on to the other side thereof so as to keep watertightness, the tip portions of the lead conductors on the other side of said insulating substrate film 1' are connected by fuse element 3', which is covered with flux layer 5', and insulating covering film 4' is allowed to adhere to the other side of insulating substrate film 1' with flux layer 5' covered.

This thin type fuse has the following advantages. The introduction of the thin type fuse makes it possible to simplify the manufacturing process because of fewer stages in the process. In addition, the contact surface of the insulating substrate film with the insulating covering film is a flat surface without intervention of other members between these films and both films are bonded to each other at the contact surface by welding or with adhesives to easily keep excellent sealing properties against inner pressure produced by expansion of the flux on fuse-blowing, which makes it possible to protect a mist from flying in all directions.

A current fuse or thermal fuse works when the fuse element reaches its melting point by Joule heat stemming from an overcurrent or by overheating from the outside, thus to fuse. On the other hand, these fuses are required not to work by transient pulse currents developed on on-off switching.

The results of tests carried out by the present inventor indicate, however, that in the above-mentioned thin type fuse, transient pulse current-flow repeated a large number of times causes a change in fusing characteristics or breaking of wire, depending on the distortion of the fuse elements, so that use of this thin type fuse may lead to restriction of service conditions.

SUMMARY OF THE INVENTION

It is an object of the present invention to provide a thin type fuse which can sufficiently keep initial fusing characteristics in spite of the pulse overcurrent-flow repeated many times.

A thin type fuse of the present invention has a structure in which each tip portion of a pair of lead conductors is put out from one side of an insulating substrate film on to the other side thereof, the tip portions of the lead conductors on the other side of the insulating substrate film are connected by a fuse element, and the other side of the insulating substrate film is covered with an insulating covering film which is in contact with the fuse element. The contact of the fuse element with the insulating covering film is surface contact and a flux is filled around said contact surface.

PREFERRED EMBODIMENTS OF THE INVENTION

Embodiments of the present invention are illustrated below with reference to drawings.

Figure 1A:
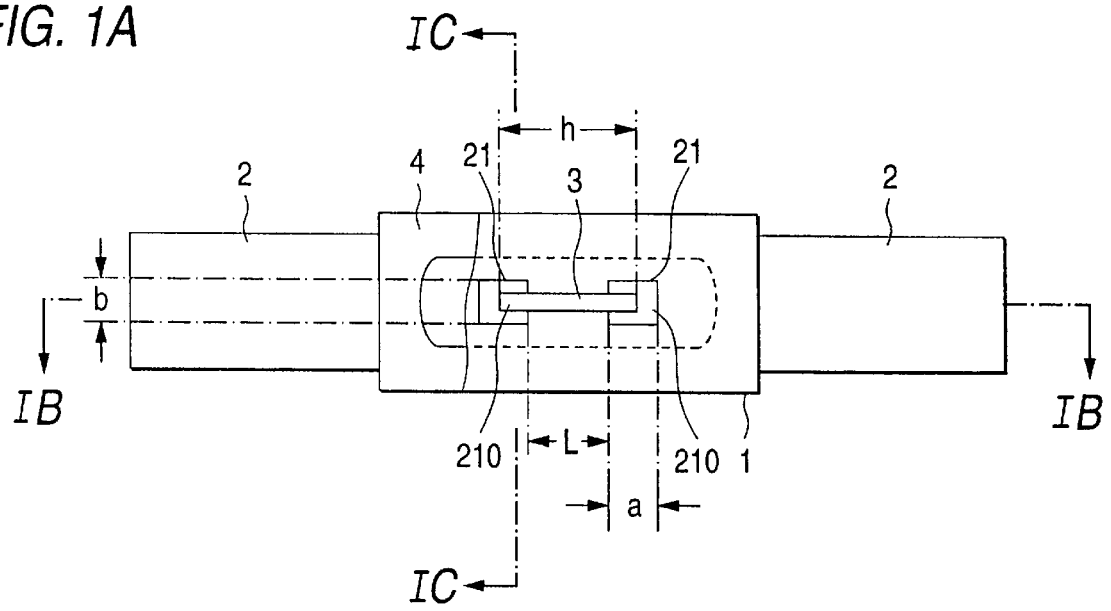
FIG. 1A is a plan view showing part of the thin type fuse of the present invention.
Figure 1B:
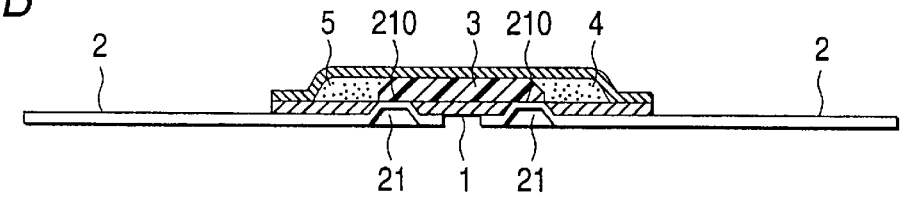
FIG. 1B is a diagram of IB—IB cross section specified in FIG. 1A.
Figure 1C:
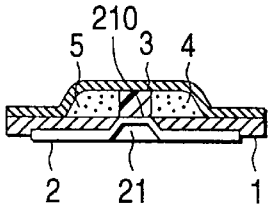
FIG. 1C is a diagram of IC—IC cross section specified in (A) of FIG. 1.
Figure 1D:
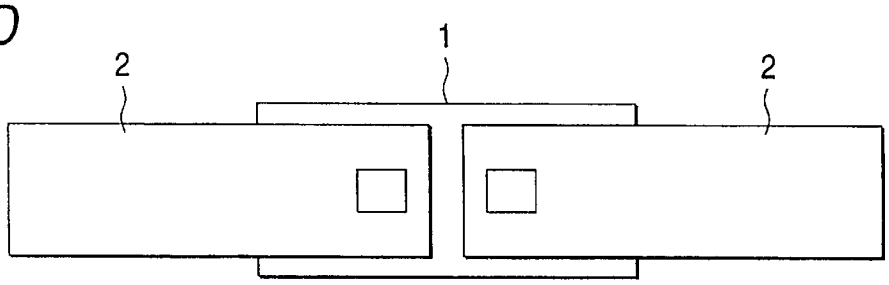
FIG. 1D is an underside view showing an example of the same thin type fuse.

FIG. 1A is a plan view showing part of the thin type fuse of the present invention; FIG. 1B is a diagram of B—B cross section specified in FIG. 1A; FIG. 1C is a diagram of IC—IC cross section specified in FIG. 1A; and FIG. 1D is a underside view showing the same thin type fuse.

In FIGS. 1A to 1D, reference numeral 1 designates a plastic insulating substrate film. Reference numeral 2 designates a pair of band-like lead conductors. A swollen portion 21 is formed in the tip portion of each conductor 2, the tip portion of each conductor contacts with the back of the insulating substrate film 1, the swollen portion 21 is put out to the face of the insulating substrate film 1, and at the same time, the insulating substrate film 1 is bonded to the band-like lead conductor 2 at their contact surfaces. Reference numeral 3 designates a fuse element connected to emerging portions 210 and 210 of the band-like lead conductors by welding or brazing, and a low melting metal piece having a specified melting point is used as the fuse element 3. The specified melting point in this case is preferably in the range of 57° C. to 185° C. Further, examples of the low melting metal piece are 44 In-42 Sn-Cd, 50 In-46.15 Sn-Bi, 44 In-40.6 Sn-Pb and the like. Reference numeral 4 designates a plastic insulating covering film with which the face of insulating substrate film 1 is covered and which is bonded to insulating substrate film 1 at their edges by welding or with an adhesive, and the back of the insulating covering film is brought into surface contact with the fuse element. To ensure this surface contact, the fuse element 3 is square in cross section. In this case, it is preferable that about 10% of the surface area of the fuse element contact with the insulating covering film. However, the contact ratio is not limited to about 10% in the present invention. Reference numeral 5 designates a flux which is filled between the insulating substrate film 1 and the covering film 4 while enclosing the fuse element 3.

Highly rigid plastics, particularly thermoplastics, such as polyethylene terephthalate, polyacetal, polyamide, polybutylene terephthalate, polyphenylene oxide, polyphenylene sulfide, and polysulfone can be used as the insulating substrate film 1 and the insulating covering film 4. Although both of the insulating substrate film 1 and the insulating covering film 4 are preferably formed of the same material, it also is possible to use different kinds of materials for both films.

For the band-like lead conductor 2, a single material of copper or composites in which, for example, the surface in contact with the back of the insulating substrate film 1 is formed of copper and the other portions thereof are formed of another kind of metal such as nickel can be used.

The following procedures can be applied for bonding the tip portions of the band-like lead conductors to the insulating substrate film. In one procedure, the tip portions of the lead conductors are pressed to form swollen portions, while rather smaller holes than the swollen portions are produced in the insulating substrate film. The tip portions of the band-like lead conductors are contacted with the back of the insulating substrate film and the swollen portions are put in the holes of the insulating substrate film to thermally weld the contact surfaces of both materials under pressure. In another procedure, the tip portions of the band-like lead conductors are pressed to form swollen portions and brought into contact with the back of the insulating substrate film and pressed toward the face of the insulating substrate film under heating, so that the swollen portions may be put in the face of the insulating substrate film to weld the insulating substrate film and the band-like lead conductors, and then film areas on the swollen portions are removed by grinding so that the swollen portions emerge.

Figure 2:
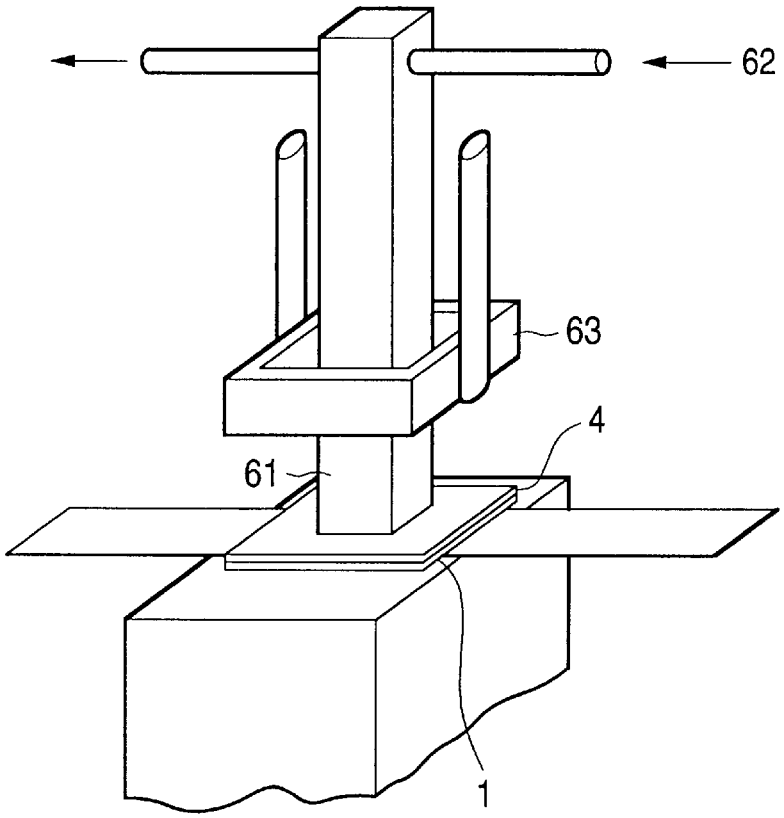
FIG. 2 is a diagram illustrating the preparation of the thin type fuse of the present invention.

In order to cover the insulating covering film, after a fuse element is connected between the emerging portions of the band-like lead conductors, as shown in FIG. 2, the insulating covering film 4 is arranged on the upper side of insulating substrate film 1, and the upper mid portion of the insulating covering film is brought into contact with a cooling cylinder 61. Then, while cooling the fuse element (a low melting metal piece) by circulating a refrigerant 62 through the cylinder 61, the periphery of the insulating covering film 4 is heat-fused to that of the insulating substrate film 1 by a heating ring 63.

The thin type fuse of the present invention, which is mounted on electrical devices so that flat areas thereof contact with the band-like lead conductors, is used as a thermal fuse or current fuse. That is, the fuse element melts by Joule heat due to an overcurrent flowing through the fuse element or by a device generation heat due to the overcurrent, and a flux melted already exerts the activation action thereof on the melted fuse element, which breaks with the progress of sphere formation to intercept current-flow to the devices.

In this case, where overcurrent is i, the resistance of a fuse element is R, the heat dissipation of the fuse element per unit time and per unit temperature difference is P, the heat capacity of the fuse element is C, the ordinary temperature is θ, and the temperature of the fuse element after an elapse of time t is T, $$i^2R\Delta t-P(T-\theta)\Delta t=C\Delta T,$$

that is, $$T=\theta+i^2R/P(1-e^{-pt/c}) \quad (1).$$

In order to intercept overcurrent i within time t, melting point $T_x$ of the fuse element is set so as to satisfy Eq. (2).

$$Tx \leqq \theta+i^2R/P(1-e^{-pt/c}) \quad (2)$$

Figure 3:
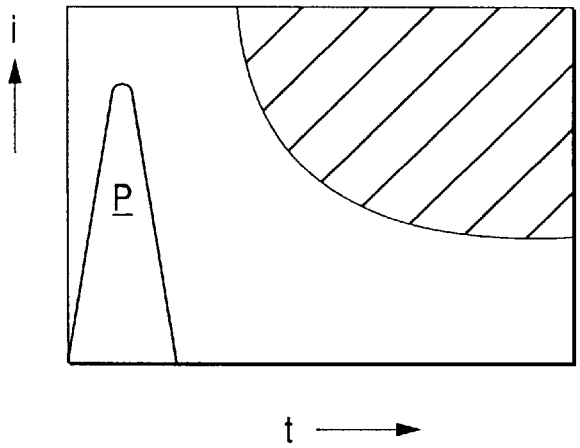
FIG. 3 is a diagram illustrating the working characteristics of the thin type fuse of the present invention.
Figure 4A:
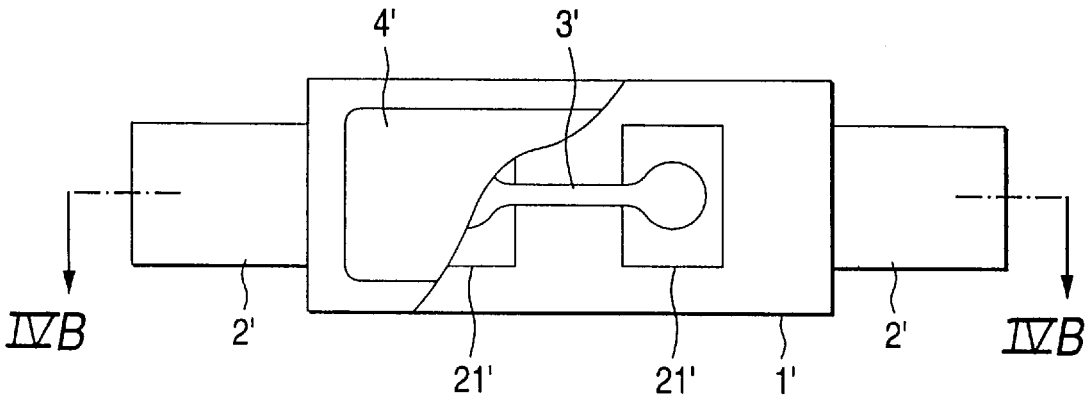
FIG. 4A is a plan view showing part of a conventional thin type fuse.
Figure 4B:
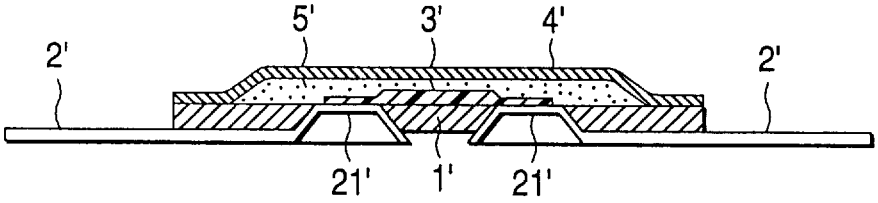
FIG. 4B is a diagram of IVB—IVB cross section specified in FIG. 4A.
Figure 4C:
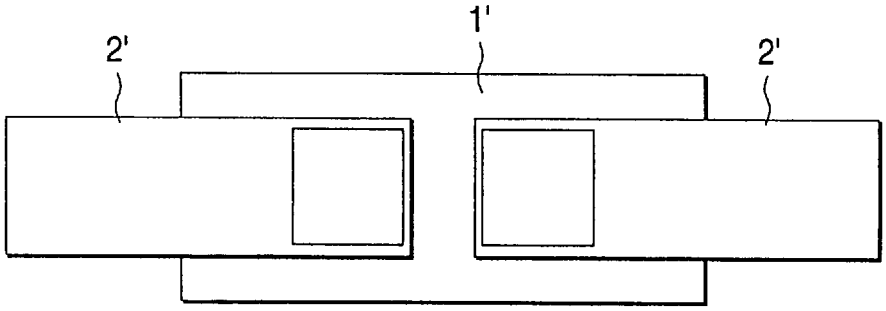
FIG. 4C is an underside view showing the same thin type fuse.

When the thin type fuse of the present invention is used as a current fuse, the melting point $T_x$, the heat dissipation P and the resistance R of the fuse element are determined so as to meet the required fusing range as shown by a portion of slant lines in FIG. 3.

When used as a current fuse or a thermal fuse, the thin type fuse of the present invention must not work through a transient voltage or current developed on on-off switching. Accordingly, the melting point, the heat dissipation P and the resistance R of the fuse element should be set so that the fuse element does not reach the melting point by pulse overcurrents as shown by P in FIG. 3.

In this case, in the thin type fuse of the present invention, the back of the insulating covering film 4, the outer surface of which is exposed to air, is brought into surface contact with the fuse element 3 and the flux 5 is filled so as to maintain such surface contact. Therefore, the heat dissipation P per unit time and per unit temperature difference can be largely increased compared with conventional thin type fuses in which the fuse elements are in contact with insulating covering films via flux layers. Consequently, rise in temperature of the fuse element 3 depending on the pulse overcurrent can be controlled. Heating of the fuse element stemming from the pulse overcurrent (heating at below its melting point) can be reduced to a slight degree, whereby fuse element fatigue or rupture depending on the pulse overcurrents generated repeatedly can be efficiently controlled to sufficiently maintain initial fusing characteristics.

In the above-mentioned embodiment of the thin type fuse of the present invention, a pair of the band-like lead conductors are oppositely located in a straight line. It also is possible, however, to arrange a pair of the band-like lead conductors in parallel to each other and to connect the fuse element to both tip portions of the band-like lead conductors at right angles to the lengthwise directions thereof.

EXAMPLES

Example

A polyethylene terephthalate film of 10.5 mm in length, 6 mm in width and 0.19 mm in thickness was used as the insulating substrate film and a 0.19 mm-thick polyethylene terephthalate film having a slightly larger size in outline than that for the insulating substrate film was used as the insulating covering film.

A copper-nickel composite of 3.5 mm in width and 0.1 mm in thickness was used as the band-like lead conductors and the length of contact of each band-like lead conductor with the back of the insulating substrate film was 4.85 mm.

The fuse element used herein was a low-melting metal wire (eutectic alloy) which was square in cross section and had a melting point of 93° C. and a cross-sectional area of 0.07 $mm^2$. The flux used was that which contained rosin as a main component.

In order to fix the tip portions of the band-like lead conductors to the insulating substrate film, the mid section of the tip portion of the band-like lead conductors were pressed to form swollen portions whereas rather smaller holes than the swollen portions were produced in the insulating substrate film. The tip portions of the band-like lead conductors were brought into contact with the back of the insulating substrate film, the swollen portions in the tip portions of the band-like lead conductors were put in the holes of the insulating substrate film, and the contact surfaces of both materials were heat-fused with the aid of heat under pressure. Adhesion of the insulating substrate film to the insulating covering film was carried out by the heat-fusion.

Dimensions of the respective other portions in this example were; a=1.62 mm, b=0.8 mm, L=2.5 mm, and h=6.0 mm, wherein, as shown in FIG. 1A, a and b are length and width of the emerging portions of the band-like lead conductors, respectively; L is clearance between both emerging portions of the band-like lead conductors; and h is length of the fuse element.

The area of contact of the fuse element with the insulating covering film was approximately 1.30 $mm^2$.

COMPARATIVE EXAMPLE

A thin type fuse was prepared in a manner similar to that of the above-mentioned example, except that a wire which had the same cross-sectional area as that of the example but was circular in cross section was used as a fuse element so that an insulating covering film does not contact with the fuse element and the flux was filled between both materials.

Regarding to the respective samples of the example and comparative example (Ten samples were prepared respectively), the backs of the band-like lead conductors were allowed to adhere to insulating resin plates and 500 cycles of a pulse overcurrent-flow test were repeated wherein 5-ampere current-flow for 1 sec—cutoff for 59 sec was one cycle. No abnormalities were detected about all samples of the example according to the present invention, whereas breaking of the fuse element was observed in six samples as to ten samples of the comparative example.

The thin type fuse of the present invention, based on the thin type fuse proposed in Examined Japanese Patent Publication No. Hei. 7-95419 as an object to be improved, can be improved in stability to a pulse overcurrent such as a transient current generated on on-off switching and is very useful as a current fuse or thermal fuse which has been required to be of still thinner type with the progress in miniaturization of devices, particularly electric devices.

What is claimed is:

1. A thin type fuse comprising:

an insulating film;

a pair of lead conductors each having an emerging portion at a respective tip portion thereof, said emerging portion protruding out from a first side of said insulating film to a second side thereof;

a fuse element connecting said tip portions of said pair of lead conductors at the second side of said insulating film; and an insulating covering film which is in direct surface contact with said fuse element and covers at least part of the second side of said insulating film wherein said insulating covering film forms an outermost layer of said fuse at a position corresponding to said fuse element.

2. The thin type fuse according to claim 1, wherein a space produced between said insulating film and said insulating covering film is filled with a flux to enclose the contact surface.

3. The thin type fuse according to claim 1, wherein said fuse element is provided between said emerging portions and is bonded to said emerging portions by welding or brazing.

4. The thin type fuse according to claim 1, wherein said insulating film and said insulating covering film are formed of the same material.

5. The thin type fuse according to claim 1, wherein said insulative film forms a substrate for said fuse element.

6. A thin type fuse comprising:

an insulating film;

a pair of lead conductors each having an emerging portion at a respective tip portion thereof, said emerging portion protruding out from a first side of said insulating film to a second side thereof, a fuse element connecting said tip portions of said pair of lead conductors at the second side of said insulating film; and an insulating covering film which is in contact with said fuse element and covers at least part of the second side of said insulating film, wherein a side of said insulating covering film opposite a side of said insulating covering film which is in direct surface contact with said fuse element is exposed to air.

7. A thin type fuse comprising:

an insulating film;

a pair of lead conductors each having an emerging portion at a respective tip portion thereof, said emerging portion protruding out from a first side of said insulating film to a second side thereof;

a fuse element connecting said tip portions of said pair of lead conductors at the second side of said insulating film; and an insulating covering film which is in direct surface contact with said fuse element and covers at least part of the second side of said insulating film, wherein a space produced between said insulating film and said insulating covering film is filled with a flux to enclose the contact surface.

8. A thin type fuse comprising:

an insulating film;

a pair of lead conductors each having an emerging portion at a respective tip portion thereof, said emerging portion protruding out from a first side of said insulating film to a second side thereof;

a fuse element connecting said tip portions of said pair of lead conductors at the second side of said insulating film; and an insulating covering film which is in contact with said fuse element and covers at least part of the second side of said insulating film, wherein said fuse element is provided between said emerging portions and is bonded to said emerging portions by welding or brazing; and wherein the contact of said fuse element with said insulating covering film forms surface contact, and wherein a space produced between said insulating film and said insulating covering film is filled with a flux to enclose the contact surface.

* * * * *